US010103461B2

(12) United States Patent
Yokoo

(10) Patent No.: US 10,103,461 B2
(45) Date of Patent: Oct. 16, 2018

(54) CONNECTION DEVICE AND TIMEPIECE

(71) Applicant: CASIO COMPUTER CO., LTD., Tokyo (JP)

(72) Inventor: Kazumasa Yokoo, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/447,719

(22) Filed: Mar. 2, 2017

(65) Prior Publication Data

US 2017/0373411 A1 Dec. 28, 2017

(30) Foreign Application Priority Data

Jun. 22, 2016 (JP) ..... 2016-123896

(51) Int. Cl.

| | |
|---|---|
| ***H01R 12/00*** | (2006.01) |
| ***H01R 12/52*** | (2011.01) |
| ***H01R 12/57*** | (2011.01) |
| ***H01R 13/24*** | (2006.01) |
| ***G04G 17/06*** | (2006.01) |

(52) U.S. Cl.

CPC ..... *H01R 12/52* (2013.01); *G04G 17/06* (2013.01); *H01R 12/57* (2013.01); *H01R 13/24* (2013.01)

(58) Field of Classification Search

CPC ..... H01R 12/52; H01R 12/57; H01R 13/24; G04G 17/06

USPC ..... 439/81, 66, 862

See application file for complete search history.

(56) References Cited

U.S. PATENT DOCUMENTS 3,026,707 A * 3/1962 Marti ..... G04D 1/063 174/86
3,905,666 A * 9/1975 Grimm ..... G04G 17/02 439/427
3,910,029 A * 10/1975 Yamazaki ..... G04C 17/00 349/149
3,914,021 A * 10/1975 Nishimura ..... G02F 1/1345 349/152

(Continued)

FOREIGN PATENT DOCUMENTS

JP S51-46064 U 4/1976
JP S57-112287 U 7/1982

(Continued)

OTHER PUBLICATIONS

Notification of Reasons for Refusal dated Feb. 16, 2018 received in Japanese Patent Application No. JP 2016-123896 together with an English language translation.

*Primary Examiner* — Abdullah Riyami
*Assistant Examiner* — Vladimir Imas
(74) *Attorney, Agent, or Firm* — Scully, Scott, Murphy & Presseer, P.C.

(57) ABSTRACT

A connection device including a plurality of substrates which are arranged overlapping with one another at predetermined intervals and have electrodes provided on respective opposing surfaces thereof, a connection member which has a main body section that is fixed to any one of the plurality of substrates, and a plurality of contact sections that are provided on the main body section and arranged among the plurality of substrates so as to respectively come in contact with the electrodes, and a fixing member which fixes the plurality of substrates and the main body section of the connection member to each other.

8 Claims, 9 Drawing Sheets

(56) References Cited

U.S. PATENT DOCUMENTS 3,945,196 A * 3/1976 Wood ..... G04G 17/02 368/280
4,083,177 A * 4/1978 Nishimura ..... G02F 1/13452 361/679.03
4,114,365 A * 9/1978 Matsuura ..... G04C 10/00 29/854
4,259,551 A * 3/1981 Ohtani ..... G04C 3/001 200/302.2
4,272,838 A * 6/1981 Kasama ..... H01M 2/1044 368/242
4,368,369 A * 1/1983 Matsumoto ..... G04G 21/08 200/292
4,403,315 A * 9/1983 Saito ..... G04G 17/06 200/5 A
4,412,133 A * 10/1983 Eckes ..... H01L 21/6831 250/442.11
4,428,683 A * 1/1984 Saito ..... G04G 17/06 368/250
4,435,796 A * 3/1984 Saito ..... G04G 17/06 200/5 A
4,836,107 A * 6/1989 Lang ..... F41G 7/22 102/206
4,970,512 A * 11/1990 Wood ..... G04C 3/005 200/11 DA
5,229,982 A * 7/1993 Kuo ..... G04C 21/02 368/250
5,438,482 A 8/1995 Nakamura et al.
5,701,229 A * 12/1997 Yamamoto ..... G11B 31/00 361/617
5,703,837 A * 12/1997 Umemoto ..... G04B 19/12 368/227
6,375,474 B1 * 4/2002 Harper, Jr. ..... H01R 13/2435 439/66
6,614,725 B2 * 9/2003 Marquis ..... G04C 10/00 368/204
6,887,114 B2 * 5/2005 Liao ..... H01R 13/2442 439/66
6,893,269 B2 * 5/2005 Matsunaga ..... H01R 12/52 439/66
6,955,552 B2 * 10/2005 Ferri ..... H01R 33/945 200/51.09
7,258,550 B2 * 8/2007 Chen ..... H01R 13/2435 439/66
7,480,213 B2 * 1/2009 Muraji ..... G04B 19/16 368/223
7,731,509 B1 * 6/2010 Zhang ..... H01R 12/57 439/81
7,798,822 B2 * 9/2010 Eldridge ..... G01R 1/07314 439/81
7,938,652 B2 * 5/2011 Yang ..... H01R 12/716 439/81
8,179,692 B2 * 5/2012 Ihara ..... H01L 24/13 257/696
8,398,300 B2 * 3/2013 Chan ..... G04B 37/0427 368/276
8,599,076 B2 * 12/2013 Yokoo ..... G04R 60/12 343/702
9,041,607 B2 * 5/2015 Yokoo ..... G04R 60/12 343/702
9,170,565 B2 * 10/2015 Kobayashi ..... G04B 37/05
9,172,161 B2 * 10/2015 Walden ..... H01R 12/714
9,429,915 B2 * 8/2016 Klopfenstein ..... G04F 5/063

FOREIGN PATENT DOCUMENTS

JP H07-45982 A 2/1995
JP H11-87872 A 3/1999
JP 2001-311785 A 11/2001

* cited by examiner

CONNECTION DEVICE AND TIMEPIECE

CROSS-REFERENCE TO RELATED APPLICATION

This application is based upon and claims the benefit of priority from the prior Japanese Patent Application No. 2016-123896, filed Jun. 22, 2016, the entire contents of which are incorporated herein by reference.

BACKGROUND OF THE INVENTION

1. Field of the Invention

The present invention relates to a connection device that is used for electronic apparatuses such as wristwatches, mobile phones, and portable digital assistants, and a timepiece having the same.

2. Description of the Related Art

For example, a wristwatch is known which has a structure including a connection device that electrically connects a timepiece module in a wristwatch case and a rear cover made of a metal so as to prevent functional abnormality caused by static electricity, as described in Japanese Patent Application Laid-Open (Kokai) Publication No. 2001-311785.

This type of connection device is structured to electrically connect a timepiece module and a rear cover by forming a plate spring section in a metal circuit support plate that presses a circuit board in the timepiece module and by bringing this plate spring section into contact with the rear cover.

In this connection device for a wristwatch, if the circuit support plate which presses the circuit board and the rear cover are far apart from each other, the plate spring section is required to be formed in the circuit support plate such that it is longer than the spacing between the circuit support plate and the rear cover. As a result, the contact of the plate spring section with the rear cover easily becomes unstable and therefore connection reliability cannot be ensured.

SUMMARY OF THE INVENTION

In accordance with one aspect of the present invention, there is provided a connection device comprising: a plurality of substrates which are arranged overlapping with one another at predetermined intervals and have electrodes provided on respective opposing surfaces thereof; a connection member which has a main body section that is fixed to any one of the plurality of substrates, and a plurality of contact sections that are provided on the main body section and arranged among the plurality of substrates so as to respectively come in contact with the electrodes; and a fixing member which fixes the plurality of substrates and the main body section of the connection member to each other.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment where the present invention has been applied in a wristwatch will hereinafter be described with reference to FIG. 1 to FIG. 7D.

Figure 1:
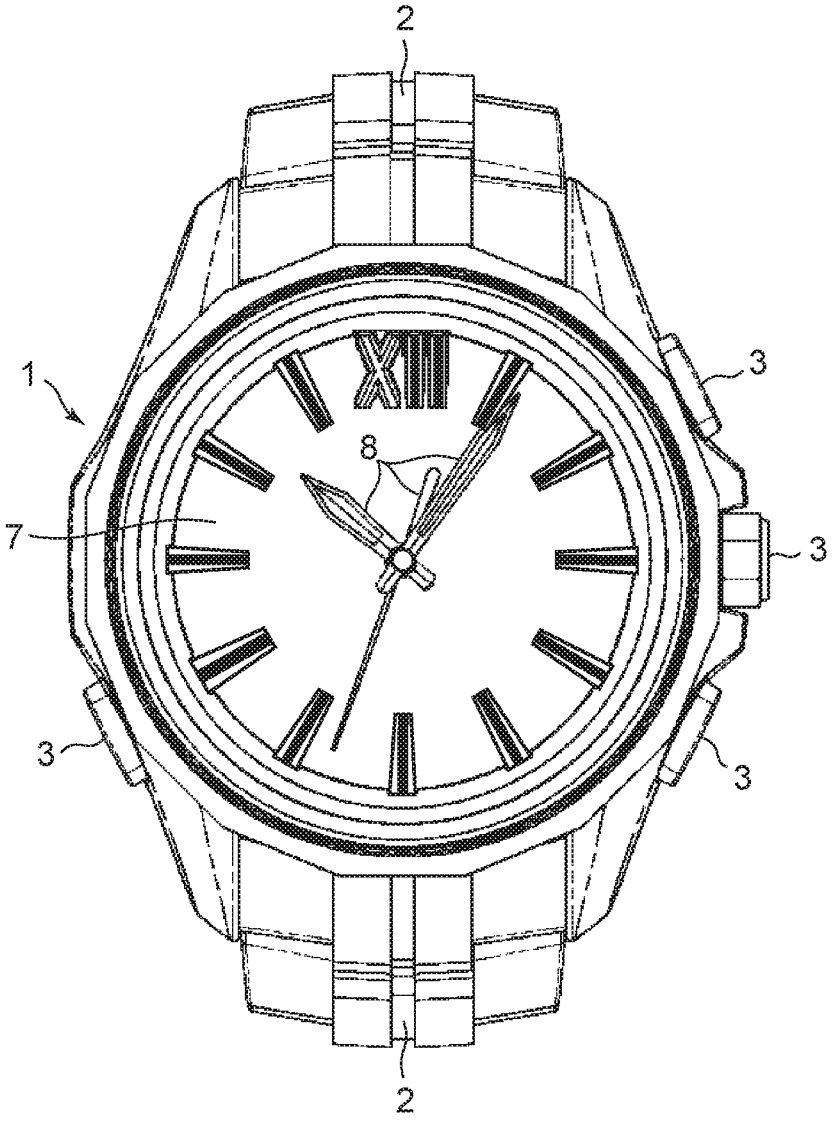
FIG. 1 is an enlarged front view showing an embodiment where the present invention has been applied in a wristwatch.
Figure 2:
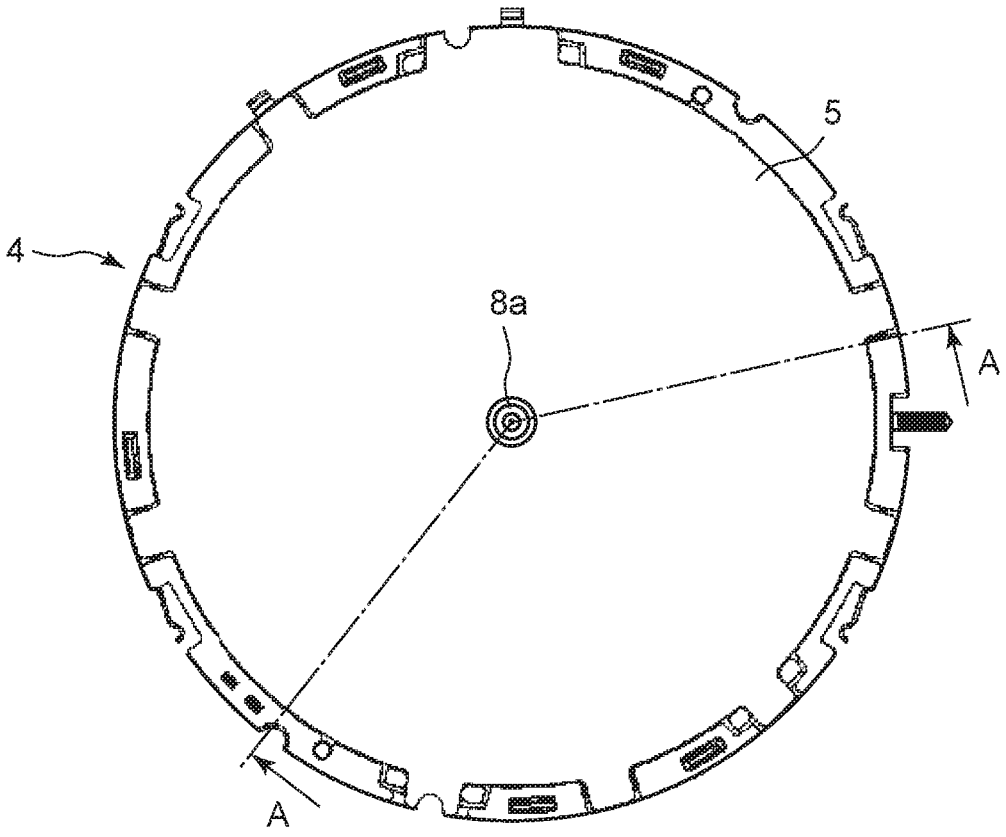
FIG. 2 is an enlarged front view showing a timepiece module incorporated into the wristwatch shown in FIG. 1.

The wristwatch includes a wristwatch case 1, as shown in FIG. 1. On the 12 o'clock side and the 6 o'clock side of the wristwatch case 1, timepiece bands 2 are respectively attached, and switch sections 3 are respectively provided on the 2 o'clock side, the 3 o'clock side, the 4 o'clock side, and the 8 o'clock side of the wristwatch case 1.

In this wristwatch case 1, a timepiece module 4 is provided, as shown in FIG. 2 to FIG. 5. The timepiece module 4, which includes an analog block 5 and a circuit block 6, is structured such that the analog block 5 and the circuit block 6 are vertically layered. The analog block 5 includes a timepiece movement having a gear train mechanism (neither of them are shown), and is structured such that a dial 7 (see FIG. 3) is arranged on its upper surface.

Figure 3:
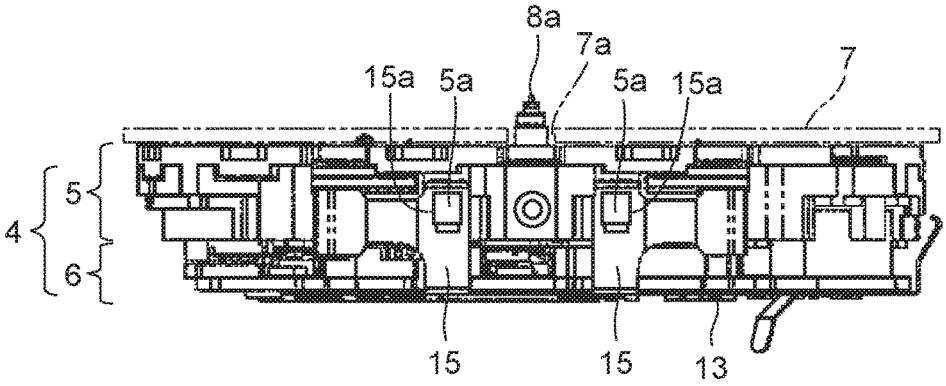
FIG. 3 is an enlarged side view showing the timepiece module shown in FIG. 2.
Figure 5:
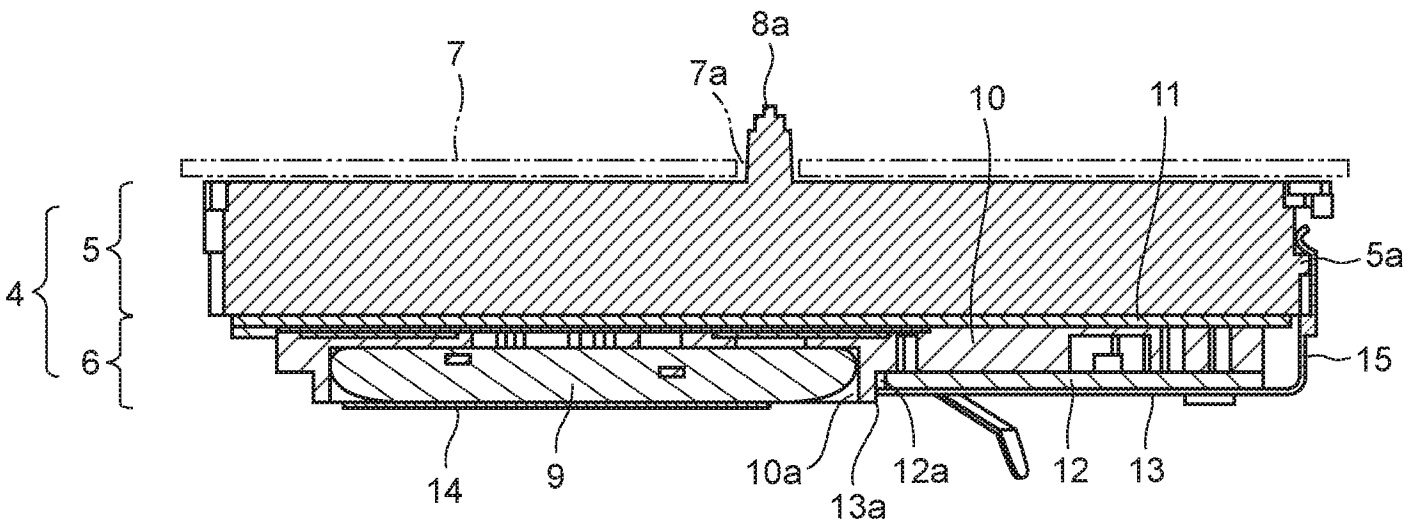
FIG. 5 is an enlarged sectional view of the timepiece module taken along line A-A shown in FIG. 2.

That is, the analog block 5 is structured such that a hand shaft 8*a* in the gear train mechanism in the timepiece movement projects upward from the dial 7 via a through hole 7*a* in the dial 7 as shown in FIG. 1, FIG. 3, and FIG. 5, hands 8 such as a second hand, a minute hand, and an hour hand are attached to the upper end of the projecting hand shaft 8*a*, and the hands 8 move above the dial 7 so as to indicate the time, as shown in FIG. 1.

Figure 4:
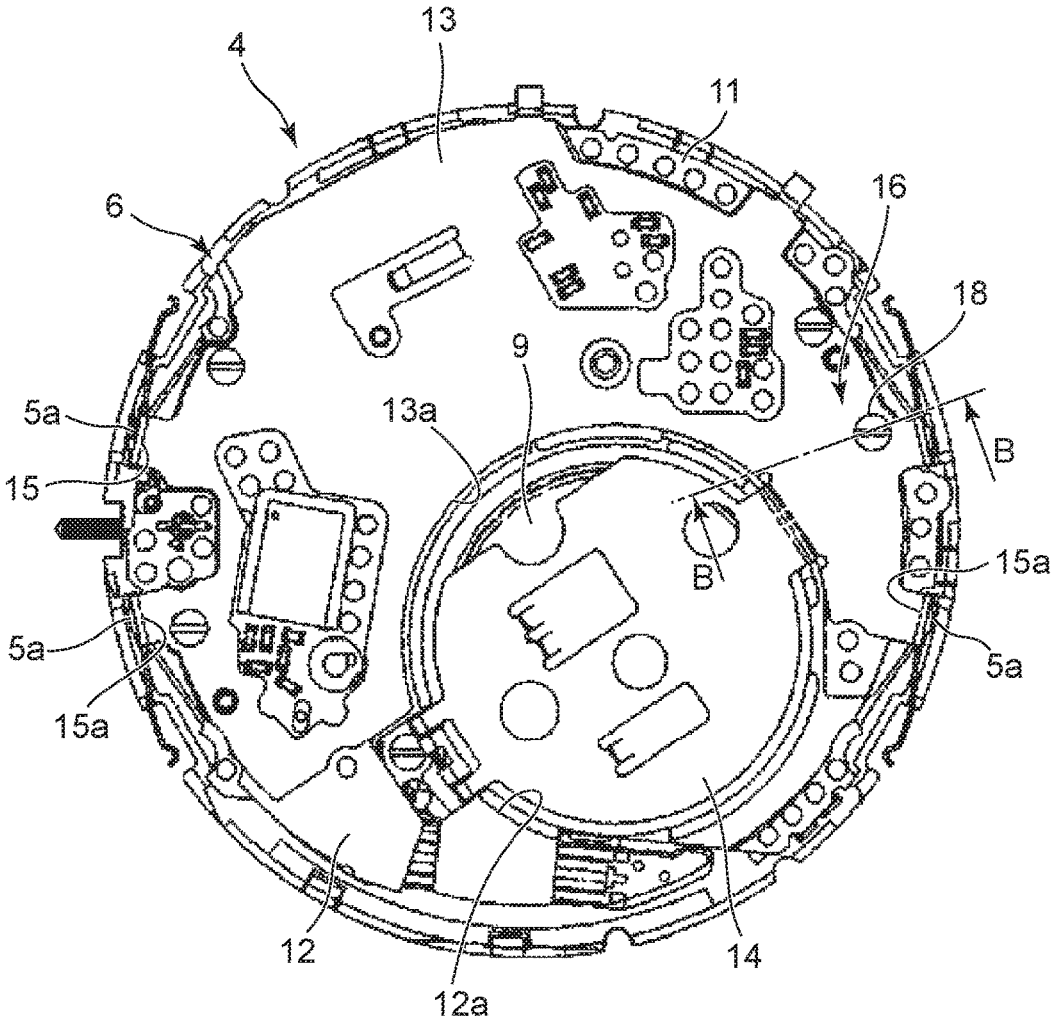
FIG. 4 is an enlarged rear view showing the timepiece module shown in FIG. 2.

The circuit block 6 includes a housing 10 serving as a spacer member where a button type battery 9 is mounted, a first circuit board 11 arranged on the upper surface of this housing 11, a second circuit board 12 arranged on the lower surface of the housing 10, and a bottom plate 13 serving as a conductive member for mounting the housing 10, the first circuit board 11, and the second circuit board 12 on the lower side of the analog block 5, as shown in FIG. 4 and FIG. 5. In this embodiment, the housing 10 is provided with a battery housing section 10*a* for housing the battery 9.

The first circuit block 11 is structured to be arranged on the lower surface of the analog block 5 with it being arranged on the upper surface of the housing 10 as shown in FIG. 5, and to be electrically connected to the timepiece movement (not shown) of the analog block 5 in this state. The second circuit board 12 is structured to be arranged on an area on the lower surface of the housing 10 excluding an area corresponding to the battery housing section 10*a* in the housing 10.

That is, in this second circuit board 12, a board opening section 12*a* for housing the battery 9 in the battery housing section 10*a* of the housing 10 is provided corresponding to the battery housing section 10*a* in the housing 10, as shown in FIGS. 4 and 5. On the lower surface of the second circuit board 12, the metal bottom plate 13 serving as a conductive member is arranged.

In this bottom plate 13, a main plate opening section 13*a* for storing the battery 9 in the battery housing section 10*a* of the housing 10 is provided corresponding to the board opening section 12*a* in the second circuit board 12, as shown in FIG. 4 and FIG. 5. In this embodiment, the battery 9 is structured to be pressed into and fixed to the battery storage unit 10*a* by an electrode plate 14 with it being arranged in the battery housing section 10*a* of the housing 10 via the main plate opening section 13*a* of the bottom plate 13 and the board opening section 12*a* of the second circuit board 12.

Also, on outer peripheral portions of the bottom plate 13, a plurality of hook sections 15 are provided projecting upward toward the outer peripheral surface of the analog block 5, as shown in FIG. 3 to FIG. 5. Each of the plurality of hook sections 15 has a rectangular locking hole 15*a* provided at its upper end and is structured such that a projection section 5*a* provided projecting toward the outer peripheral surface of the analog block 5 engages with this locking hole 15*a*, as shown in FIG. 3.

That is, the plurality of hook sections 15 are structured such that, when the bottom plate 13, the second circuit board 12, the housing 10, the first circuit board 11, and the analog block 5 are overlapped in this order from below, the plurality of hook sections 15 extend upward along their outer peripheral surfaces, and the projection sections 5*a* provided on the outer peripheral surface of the analog block 5 respectively engage with the locking holes 15*a* at the extending upper ends, as shown in FIG. 3 and FIG. 5.

As a result, the bottom plate 13 is structured such that, when it is arranged on the lower surface of the second circuit board 12 with the second circuit board 12, the housing 10, the first circuit board 11, and the analog block 5 being overlapped, the second circuit board 12, the housing 10, the first circuit board 11, and the analog block 5 are integrally assembled by the projection sections 5*a* provided on the outer peripheral surface of the analog block 5 respectively engaging with the locking holes 15*a* in the plurality of hook sections 15, as shown in FIG. 3 and FIG. 5.

Figure 6:
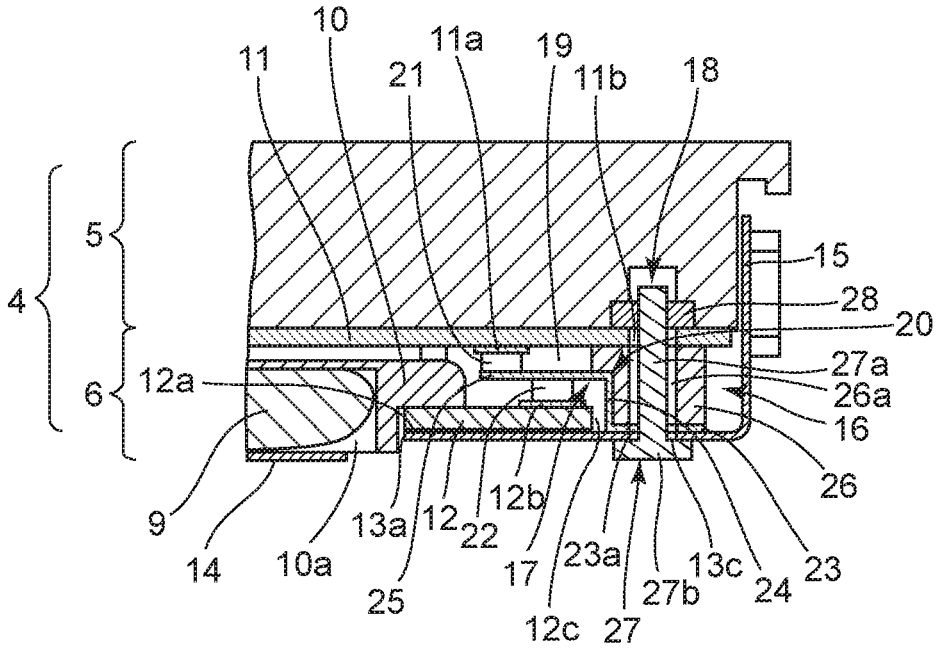
FIG. 6 is an enlarged sectional view of the main section of the timepiece module taken along line B-B shown in FIG. 4.
Figure 7A:
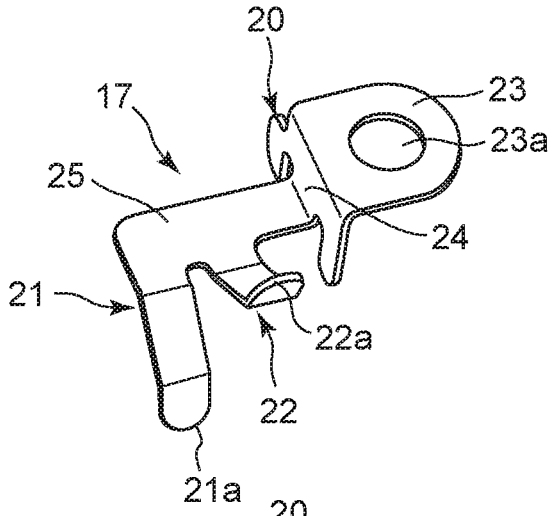
FIG. 7A is an enlarged perspective view showing a connection member in a connection device shown in FIG. 6 in a vertically reversed manner.
Figure 7B:
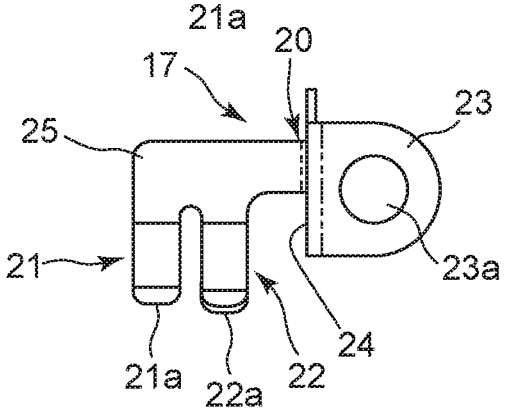
FIG. 7B is an enlarged planar view showing the connection member in the connection device shown in FIG. 6 in a vertically reversed manner.
Figure 7C:
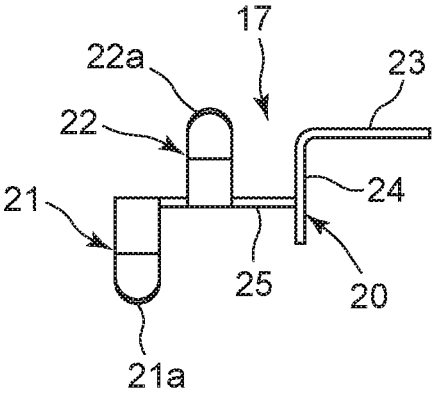
FIG. 7C is an enlarged side view showing the connection member in the connection device shown in FIG. 6 in a vertically reversed manner.
Figure 7D:
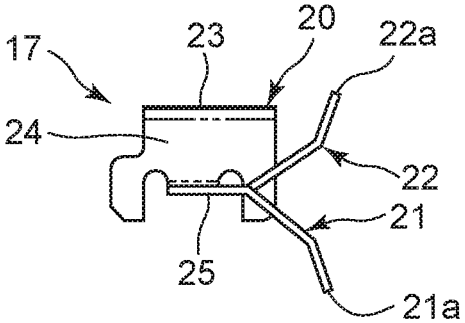
FIG. 7D is an enlarged front view showing the connection member in the connection device shown in FIG. 6 in a vertically reversed manner.
Figure 8A:
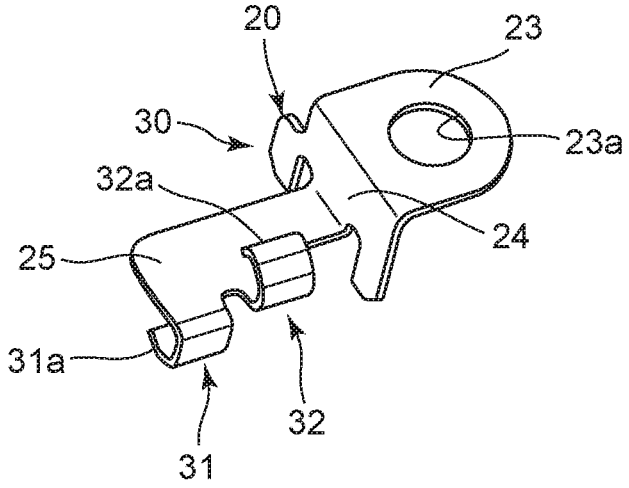
FIG. 8A is an enlarged perspective view showing a first modification of the connection member used in the connection device according to the present invention in a vertically reversed manner.
Figure 8B:
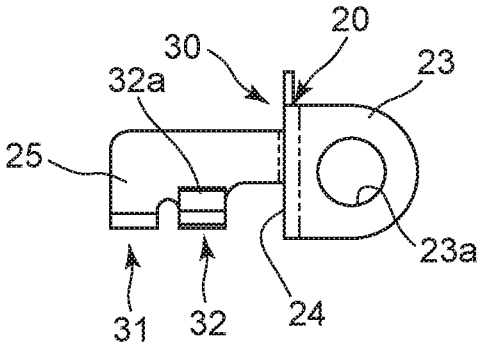
FIG. 8B is an enlarged planar view showing the first modification of the connection member used in the connection device according to the present invention in a vertically reversed manner.
Figure 8C:
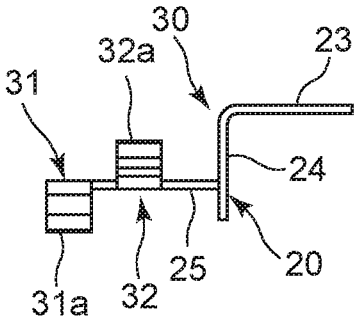
FIG. 8C is an enlarged side view showing the first modification of the connection member used in the connection device according to the present invention in a vertically reversed manner.
Figure 8D:
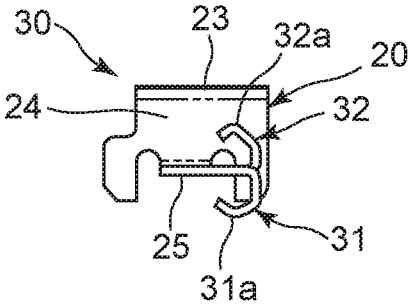
FIG. 8D is an enlarged front view showing the first modification of the connection member used in the connection device according to the present invention in a vertically reversed manner.
Figure 9A:
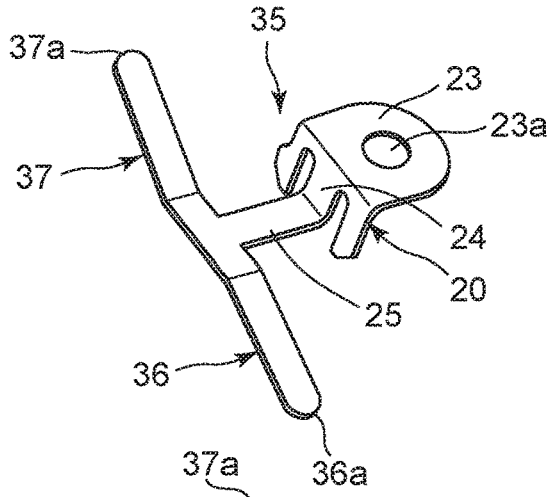
FIG. 9A is an enlarged perspective view showing a second modification of the connection member used in the connection device according to the present invention in a vertically reversed manner.
Figure 9B:
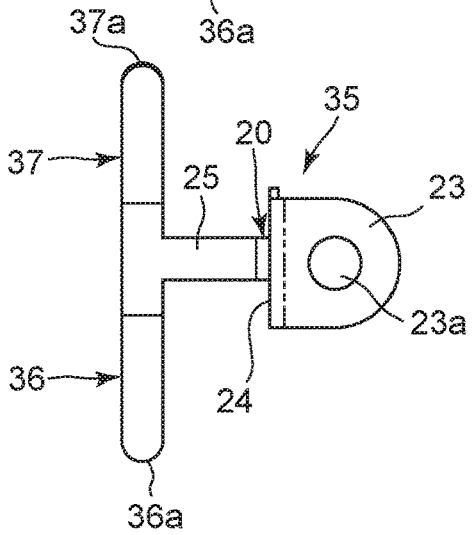
FIG. 9B is an enlarged planar view showing the second modification of the connection member used in the connection device according to the present invention in a vertically reversed manner.
Figure 9C:
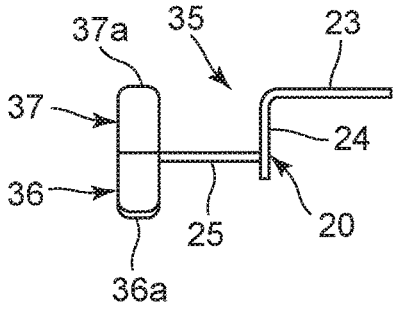
FIG. 9C is an enlarged side view showing the second modification of the connection member used in the connection device according to the present invention in a vertically reversed manner.
Figure 9D:
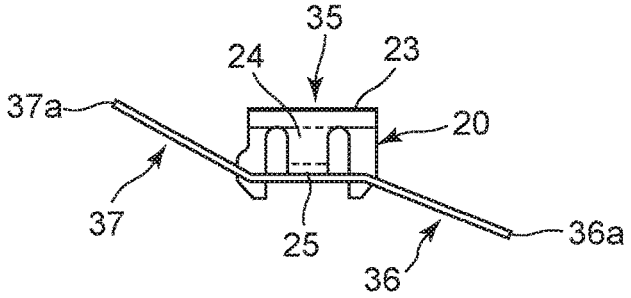
FIG. 9D is an enlarged front view showing the second modification of the connection member used in the connection device according to the present invention in a vertically reversed manner.

As shown in FIG. 4 and FIG. 6, the first circuit board 11 and the second circuit board 12 are structured to be electrically connected to each other by a connection device 16. This connection device 16 includes a connection member 17 which electrically connects the first circuit board 11 and the second circuit board 12 arranged overlapping with each other at a predetermined interval, and a fixing member 18 which presses and fixes the first circuit board 11, the second circuit board 12, the connection member 17, and the bottom plate 13 to one another, as shown in FIG. 6.

In this embodiment, the bottom plate 13 is structured to be electrically connected to the battery 9 by being connected to the electrode plate 14 which presses the battery 9 into the battery housing section 10*a* in the housing 10, with it being arranged on the lower surface of the second circuit board 12, and to be conducted by coming in contact with the connection member 17 in this state, as shown in FIG. 4 to FIG. 6. As a result, the first circuit board 11 and the second circuit board 12 are structured such that power to the battery 9 is supplied by the bottom plate 13 and the connection member 17.

The first circuit board 11 and the second circuit board 12 are arranged at a predetermined interval (i.e., the length of the thickness in the vertical direction of the housing 10) by the housing 10 serving as a spacer member arranged therebetween. In this housing 10, a connection opening section 19 is provided in which apart of the connection member 17, or in other words, a first contact section 21 and a second contact section 22 described below are arranged.

As a result, the first circuit board 11 and the second circuit board 12 are opposed to each other within an area corresponding to the connection opening section 19 of the housing 10 as shown in FIG. 6, and a first electrode 11*a* is provided on a lower surface serving as an opposite surface of the opposing first circuit board 11 while a second electrode 12*b* is provided on an upper surface serving as an opposite surface of the opposing second circuit board 12.

The connection member 17 includes a main body section 20 fixed to the housing 10 and arranged on the upper side of the second circuit board 12, the first contact section 21 provided in the main body section 20 so as to come in contact with the first electrode 11*a* of the first circuit board 11, and the second contact section 22 provided in the main body section 20 so as to come in contact with the second electrode 12*b* of the second circuit board 12, as shown in FIG. 6, FIG. 7A, FIG. 7B, FIG. 7C, and FIG. 7D, and the main body section 20, the first contact section 21, and the second contact section 22 are integrally formed of a metal plate.

That is, the main body section 20 includes a main body attachment section 23 which is arranged on the lower surface of the housing 10 while being in parallel with the second circuit board 12 and is conducted when the bottom plate 13 comes in contact therewith, an extension section 24 extending upward via a notch section 12*c* in the second circuit board 12 from the main body attachment section 23, and a holding section 25 positioned between the second circuit board 12 and the first circuit board 11 and extending substantially parallel to the second circuit board 12 and the first circuit board 11 from the extension section 24, as shown in FIG. 6, FIG. 7A, FIG. 7B, FIG. 7C, and FIG. 7D.

In this embodiment, the notch section 12*c* is provided in the second circuit board 12 with it corresponding to the main body attachment section 23 of the main body section 20, as shown in FIG. 6. Also, in the outer peripheral portion of the housing 10, a support projection section 26 in which the main body attachment section 23 is arranged is provided with it being arranged in the notch section 12*c* of the second circuit board 12. This support projection section 26 is formed such that its lower end surface is more depressed than the lower surface of the second circuit board 12 by the thickness of the main body attachment section 23 of the main body section 20.

As a result, the main body attachment section 23 is structured such that, when it is arranged on the lower surface of the support projection section 26 of the housing 10, its lower surface is substantially flush with the lower surface of the second circuit board 12, as shown in FIG. 6, FIG. 7A, FIG. 7B, FIG. 7C, and FIG. 7D. Also, the extension section 24 of the main body section 20 is structured such that, when it is arranged along the inner side surface of the support projection section 26 of the housing 10, its upper end projects into the connection opening section 19 in the housing 10 via the notch section 12*c* in the second circuit board 12.

Also, the holding section 25 is structured to be arranged extending into the connection opening section 19 in the housing 10 from the upper end of the extension section 24 while being substantially parallel to the first circuit board 11 and the second circuit board 12, as shown in FIG. 6, FIG. 7A, FIG. 7B, FIG. 7C, and FIG. 7D. The first contact section 21 and the second contact section 22 are provided in one side portion (lower side portion in FIG. 7B) of this holding section 25.

The first contact section 21 is structured such that it extends obliquely upward (obliquely downward in FIG. 7D) from the one side portion (the lower side portion in FIG. 7B) of the holding section 25 of the main body section 20, and the extending upper end (lower end in FIG. 7D) 21*a* resiliently comes in contact with the first electrode 11*a* of the first circuit board 11 from below, as shown in FIG. 6, FIG. 7A, FIG. 7B, FIG. 7C, and FIG. 7D.

The second contact section 22 is structured such that it extends obliquely downward (obliquely upward in FIG. 7D) from the one side portion (lower side portion in FIG. 7B) of the holding section 25 of the main body section 20 and the extending lower end (upper end in FIG. 7D) 22*a* resiliently comes in contact with the second electrode 12*b* of the second circuit board 12 from above, as shown in FIG. 6, FIG. 7A, FIG. 7B, FIG. 7C, and FIG. 7D.

On the other hand, the fixing member 18 is a screw member which fastens and fixes the bottom plate 13, the main body attachment section 23 in the connection member 17, the second circuit board 12, the housing 10, and the first circuit board 11 with them being overlapped in this order from below, as shown in FIG. 6. This fixing member 18 includes a bolt 27 and a nut 28. The bolt 27 includes a threaded shaft 27*a* into which the nut 28 is screwed and a head section 27*b* provided on one end of the threaded shaft 27*a*.

In this embodiment, in the support projection section 26 of the housing 10, a shaft insertion hole 26*a* into which the threaded shaft 27*a* of the bolt 27 is inserted is provided to vertically penetrate the support projection section 26, as shown in FIG. 6. Also, in the main body attachment section 23 of the connection member 17, a main body attachment hole 23*a* into which the threaded shaft 27*a* of the bolt 27 is inserted is provided to coaxially correspond to the shaft insertion hole 26*a* in the housing 10.

In the bottom plate 13 arranged on the lower surface of this main body attachment section 23, a main plate attachment hole 13*c* into which the threaded shaft 27*a* of the bolt 27 is inserted is provided to coaxially correspond to the main body attachment hole 23*a* of the main body attachment section 23, as shown in FIG. 6. Also, in the first circuit board 11, a board attachment hole 11*b* into which the threaded shaft 27*a* of the bolt 27 is inserted is provided to coaxially correspond to the shaft insertion hole 26*a* of the support projection section 26 of the housing 10.

As a result, the main plate attachment hole 13*c* of the bottom plate 13, the main body attachment hole 23*a* of the main body attachment section 23 in the connection member 17, the shaft insertion hole 26*a* of the support projection section 26 of the housing 10, and the board attachment hole 11*b* of the first circuit board 11 are structured to coaxially correspond to one another when the bottom plate 13, the main body attachment section 23 in the connection member 17, the second circuit board 12, the housing 10, the first circuit board 11 are overlapped in this order from below, as shown in FIG. 6.

Accordingly, the fixing member 18 is structured such that, in a state where the bottom plate 13, the main body attachment section 23 in the connection member 17, the housing 10, and the first circuit board 11 have been overlapped, the threaded shaft 27*a* of the bolt 27 is inserted into the main plate attachment hole 13*c* of the bottom plate 13, the main body attachment hole 23*a* of the main body attachment section 23 in the connection member 17, the shaft insertion hole 26*a* of the support projection section 26 of the housing 10, and the board attachment hole 11*b* of the first circuit board 11 in order, projected into the analog block 5 from below, and screwed into and fastened to the nut 28, as shown in FIG. 6.

In this embodiment, in the analog block 5, the nut 28 is embedded, as shown in FIG. 6. This nut 28 is provided to coaxially correspond to the board attachment hole 11*b* of the first circuit board 11 with its lower surface being exposed to the lower side of the analog block 5. Accordingly, the fixing member 18 is structured such that the threaded shaft 27*a* of the bolt 27 inserted thereinto from the main plate attachment hole 13*c* of the bottom plate 13 and projecting upward from the board attachment hole 11*b* of the first circuit board 11 is screwed into and fastened to the nut 28 in the analog block 5.

As a result, the fixing member 18 is structured such that, when the threaded shaft 27*a* of the bolt 27 projecting into the analog block 5 from the first circuit board 11 is screwed into and fastened to the nut 28, the head section 27*b* in the blot 27 presses the bottom plate 13 against the main body attachment section 23 of the main body section 20 of the connection member 17, and presses this main body attachment section 23 against the support projection section 26 of the housing 10 arranged in the notch section 12*c* in the second circuit board 12.

Also, the fixing member 18 is structured such that, when the threaded shaft 27*a* of the bolt 27 projecting into the analog block 5 from the first circuit board 11 is screwed into and fastened to the nut 28, this nut 28, together with the analog block 5, presses the first circuit board 11 against the upper surface of the housing 10, as shown in FIG. 6.

As a result, the connection member 17 is structured such that the main body attachment section 23 of the main body section 20 is interposed between the bottom plate 13 and the support projection section 26 of the housing 10 so as to be fixed by the fixing member 18; the upper end 21*a* of the first contact section 21 provided on the holding section 25 of the main body section 20 is pressed against the first electrode 11*a* of the first circuit board 11 from below so as to resiliently come in contact therewith; and the lower end 22*a* of the second contact section 22 provided on the holding section 25 of the main body section 20 is pressed against the second electrode 12*b* of the second circuit board 12 from above so as to resiliently come in contact therewith, as shown in FIG. 6.

Next, the mechanism of the timepiece module 4 in this wristwatch is described.

In the assembly of this timepiece module 4, first, the circuit block 6 is assembled in advance. Here, the first circuit board 11 is first arranged on the upper surface of the housing 10, and the second circuit board 12 is arranged on the lower surface of the housing 10 together with the connection member 17.

That is, when the first circuit board 11 is to be arranged on the upper surface of the housing 10, the board attachment hole 11*b* of the first circuit board 11 is made to coaxially correspond to the shaft insertion hole 26*a* of the support projection section 26 of the housing 10, and the first electrode 11*a* of the first circuit board 11 is made to correspond to the connection opening section 19 in the housing 10.

Also, when the second circuit board 12 is to be arranged on the lower surface of the housing 10 together with the connection member 17, the main body attachment section 23 of the main body section 20 of the connection member 17 is first arranged on the lower surface of the support projection section 26 of the housing 10 such that the main body attachment hole 23*a* of the main body attachment section 23 coaxially corresponds to the shaft insertion hole 26*a* of the support projection section 26. In addition, the extension section 24 of the main body section 20 is arranged extending upward along the inner side surface of the support projection section 26 of the housing 10, and the holding section 25 of the main body section 20 is arranged within the connection opening section 19 in the housing 10.

In this state, the second circuit board 12 is arranged on the lower surface of the housing 10. Here, the support projection section 26 of the housing 10 and the extension section 24 of the main body section 20 of the connection member 17 are arranged in the notch section 12*c* in the second circuit board 12 such that the second electrode 12*b* of the second circuit board 12 corresponds to the connection opening section 19 in the housing 10. Also, here, the substrate opening section 12*a* in the second circuit board 12 is made to correspond to the battery housing section 10*a* in the housing 10.

In this state, the first circuit board 11 and the second circuit board 12 are opposed to each other with the connection opening section 19 in the housing 10 being interposed therebetween, and the holding section 25 of the connection member 17 is arranged between this first circuit board 11 and this second circuit board 12 together with the first contact section 21 and the second contact section 22. Accordingly, the upper end 21*a* of the first contact section 21 corresponds to the first electrode 11*a* of the first circuit board 11 so as to resiliently come in contact therewith, and the lower end 22*a* of the second contact section 22 corresponds to the second electrode 12*b* of the second circuit board 12 so as to resiliently come in contact therewith.

In this state, the bottom plate 13 is arranged on the lower surface of the second circuit board 12. Here, the main plate opening section 13*a* in the bottom plate 13 is made to correspond to the board opening section 12*a* in the second circuit board 12 and the battery housing section 10*a* in the housing 10, and the main plate attachment hole 13*c* in the bottom plate 13 is made to coaxially correspond to the main body attachment hole 23*a* in the main body attachment section 23 of the connection member 17 and the shaft insertion hole 26*a* in the support projection section 26 of the housing 10.

Also here, the plurality of hook sections 15 provided on the outer peripheral portion of the bottom plate 13 are arranged with the respective upper ends projecting upward from the first circuit board 11 via each of outer peripheral portions of the second circuit board 12, the housing 10, and the first circuit board 11. As a result, the assembly of the circuit block 6 is completed.

Then, the analog block 5 is mounted on this circuit block 6. Here, the nut 28 of the fixing member 18 is embedded in the analog block 5 in advance with it being exposed to the lower side of the analog block 5. In this state, the analog block 5 is arranged on the circuit block 6. Here, the nut 28 embedded in the analog block 5 is made to coaxially correspond to the board attachment hole 11*b* provided in the first circuit board 11 in the circuit block 6.

In this state, the analog block 5 is arranged on the circuit board 11 in the circuit block 6. Here, the plurality of hook sections 15 provided on the outer periphery of the bottom plate 13 are arranged extending upward along the outer peripheral surface of the analog block 5. Accordingly, at the upper end of each of the plurality of hook sections 15, the projection section 5*a* provided on the outer peripheral portion of the analog block 5 engages with the locking hole 15*a*.

As a result, the second circuit board 12, the housing 10, and the first circuit board 11 overlap with one another and the analog block 5 overlaps with the first circuit board 11 by the bottom plate 13 and the plurality of hook sections 15. In this state, the analog block 5 and the circuit block 6 are integrally assembled.

Then, the fixing member 18 in the connection device 16 fixes the connection member 17. Here, the threaded shaft 27*a* of the bolt 27 of the fixing member 18 is screwed into and fastened to the nut 28 in the analog block 5 via the main plate attachment hole 13*c* of the bottom plate 13, the main body attachment hole 23*a* of the main body attachment section 23 in the connection member 17, the shaft insertion hole 26*a* of the support projection section 26 of the housing 10, and the board attachment hole 11*b* of the first circuit board 11 from below the circuit block 6.

As a result, the head section 27*b* of the bolt 27 of the fixing member 18 presses the bottom plate 13 against the main body attachment section 23 of the main body section 20 of the connection member 17 and presses and fixes the main body attachment section 23 to the support projection section 26 of the housing 10. In addition, the nut 28 in the analog block 5, together with the analog block 5, presses and fixes the first circuit board 11 to the upper surface of the housing 10.

Accordingly, in the connection member 17 in the connection device 16, the main body attachment section 23 of the main body section 20 is interposed between the bottom plate 13 and the support projection section 26 of the housing 10 and fixed by the fixing member 18. In this state, the upper end 21*a* of the first contact section 21 provided on the holding section 25 of the main body section 20 is pressed against the first electrode 11*a* of the first circuit board 11 from below so as to resiliently come in contact therewith, and the lower end 22*a* of the second contact section 22 is pressed against the second electrode 12*b* of the second circuit board 12 from above so as to resiliently come in contact therewith.

As a result, the connection device 16 is mounted to the circuit block 6. Here, in the connection device 16, the bottom plate 13 arranged on the lower surface of the second circuit board 12 is electrically connected to the electrode plate 14 which presses the battery 9 into the battery housing section 10*a* in the housing 10, so that the bottom plate 13 and the battery 9 are electrically connected to each other. In addition, the bottom plate 13 is conducted by coming in contact with the main body attachment section 23 of the main body section 20 of the connection member 17, so that the battery 9 and the connection member 17 are electrically connected to each other.

Thus, in this connection device 16, the first contact section 21 of the connection member 17 is conducted by coming in contact with the first electrode 11*a* of the first circuit board 11, and the second contact section 22 of the connection member 17 is conducted by coming in contact with the second electrode 12*b* of the second circuit board 12. Therefore, the power to the battery 9 is reliably and satisfactorily supplied to the first circuit board 11 and the second circuit board 12.

As such, the connection device 16 in the timepiece module 4 in this wristwatch enables connection reliability to be enhanced by including the first and second circuit boards 11 and 12 arranged overlapping with each other at a predetermined interval and respectively having the first and second electrodes 11*a* and 12*b* provided on their opposite surfaces; the connection member 17 having the main body section 20 fixed to the second circuit board 22 and the first and second contact sections 21 and 22 which are arranged between the first circuit board 11 and the second circuit board 12 and respectively come in contact with the first and second electrodes 11*a* and 12*b*; and the fixing member 18 which fixes the first circuit board 11, the second circuit board 12, and the connection member 17 to one another.

That is, in the connection device 16 in this timepiece module 4, the first circuit board 11, the second circuit board 12, and the connection member 17 can be mutually fixed to one another by the fixing member 18. Accordingly, by the fixing force of the fixing member 18, the first contact section 21 of the connection member 17 is reliably pressed against the first electrode 11*a* of the first circuit board 11 so as to come in contact therewith, and the second contact section 22 is reliably pressed against the second electrode 12*b* in the second circuit board 12 so as to come in contact therewith. As a result, even though the first circuit board 11 and the second circuit board 12 are far apart from each other, a stable connection state can be ensured so that connection reliability can be enhanced.

Also, the connection device 16 in this timepiece module 4 includes the metal bottom plate 13 serving as a conductive member which is connected to a power source while coming in contact with the main body section 20 of the connection member 17. Accordingly, by the bottom plate 13, power can be supplied to the main body section 20 of the connection member 17. In addition, by the first contact section 21 and the second contact section 22 provided in the main body section 20, power can be reliably and satisfactorily supplied to the first circuit board 11 and the second circuit board 12.

That is, the connection device 16 can electrically connect the bottom plate 13 and the battery 9 to each other by the bottom plate 13 being electrically connected to the electrode plate 14 which presses and fixes the battery 9 to the battery housing section 10*a* in the housing 10, and can electrically connect the battery 9 and the connection member 17 to each other by the bottom plate 13 being conducted by coming in contact with the main body attachment section 23 of the main body section 20 of the connection member 17.

Thus, in the connection device 16, by the first contact section 21 of the connection member 17 being in contact with the first electrode 11*a* of the first circuit board 11 and the second contact section 22 being in contact with the second electrode 12*b* of the second circuit board 12, power to the battery 9 can be reliably and satisfactorily supplied to the first circuit board 11 and the second circuit board 12.

In this embodiment, the housing 10 serving as a spacer member is arranged between the first circuit board 11 and the second circuit board 12. This housing 10 is provided with the connection opening section 19 in which the first contact section 21 and the second contact section 22 are arranged. As a result of this structure, the first contact section 21 and the second contact section 22 of the connection member 17 are satisfactorily arranged in the connection opening section 19 in the housing 10, and the first circuit board 11 and the second circuit board 12 are reliably opposed to each other.

Also, the opposite surfaces of the first circuit board 11 and the second circuit board 12 in an area corresponding to the connection opening section 19 in the housing 10 are respectively provided with the first electrode 11*a* and the second electrode 12*b*. As a result of this structure, when the first contact section 21 and the second contact section 22 of the connection member 17 are arranged in the connection opening section 19 in the housing 10, the first contact section 21 reliably corresponds to the first electrode 11*a* of the first circuit board 11 so as to come in contact therewith, and the second contact section 22 reliably corresponds to the second electrode 12*b* of the second circuit board 12 to come in contact therewith.

Also, in the connection device 16, the main body section 20 of the connection member 17 includes the main body attachment section 23 arranged in the housing 10 in parallel with the second circuit board 12, the extension section 24 extending toward an area between the second circuit board 12 and the first circuit board 11 from the main body attachment section 23, and the holding section 25 which is positioned in an area between the first circuit board 11 and the second circuit board 12 in a manner to extend substantially parallel to them from the extension section 24 and is provided with the first contact section 21 and the second contact section 22, whereby the connection member 17 can be simply and reliably assembled.

That is, in the connection device 16, only by the main body attachment section 23 being arranged on the lower surface of the support projection section 26 of the housing 10 such that the extension section 24 is arranged on the inner side surface of the support projection section 26, and by the support projection section 26 of the housing 10 being arranged in the notch section 12*c* in the second circuit board 12 in this state, the holding sections 25 provided with the first contact section 21 and the second contact section 22 can be arranged within the connection opening section 19 in the housing 10 and, in this state, the connection member 17 can be reliably attached to the housing 10.

Also, in this connection device 16, the connection member 17 includes the first contact section 21 which resiliently comes in contact with the first electrode 11*a* provided on the lower surface of the first circuit board 11 positioned on the upper surface of the housing 10 serving as a spacer member, and the second contact section 22 which resiliently comes in contact with the second electrode 12*b* provided on the upper surface of the second circuit board 12 positioned on the lower surface of the housing 10. As a result of this structure, when the connection member 17 is attached to the housing 10, the first contact section 21 of the connection member 17 can be accurately brought into contact with the first electrode 11*a* of the first circuit board 11 and the second contact section 22 of the connection member 17 can be accurately brought into contact with the second electrode 12*b* of the second circuit board 12.

In this embodiment, the first contact section 21 is structured to extend obliquely upward from the one side portion of the holding section 25 of the main body section 20 such that the extending upper end 21*a* resiliently comes in contact with the first electrode 11*a* of the first circuit board 11 from below. Accordingly, when the connection member 17 is attached to the housing 10, the first contact section 21 can be accurately and reliably brought into contact with the first electrode 11*a* of the first circuit board 11.

Also, the second contact section 22 is structured to extend obliquely downward from the one side portion of the holding section 25 of the main body section 20 such that the extending lower end 22*a* resiliently comes in contact with the second electrode 12*b* of the second circuit board 12 from above. Accordingly, when the connection member 17 is attached to the housing 10, the second contact section 22 can be accurately and reliably brought into contact with the second electrode 12*b* of the second circuit board 12.

As a result, even though the first circuit board 11 and the second circuit board 12 are far apart from each other, the first contact section 21 can be accurately and reliably brought into contact with the first electrode 11*a* of the first circuit board 11 and the second contact section 22 can be accurately and reliably brought into contact with the second electrode 12*b* of the second circuit board 12. Therefore, a more stable connection state is ensured and connection reliability can be further enhanced.

Also, in the connection device 16, the fixing member 18 is a screw member which penetrates, fastens, and fixes the bottom plate 13 serving as a conductive member, the main body section 20 of the connection member 17, the second circuit board 12, the housing 10 serving as a spacer member, and the first circuit board 11 in order. Therefore, the bottom plate 13, the connection member 17, the second circuit board 12, the housing 10, and the first circuit board 11 can be reliably fastened and fixed with them being overlapped.

That is, the fixing member 18 includes the bolt 27 having the threaded shaft 27*a* and the head section 27*b* and the nut 28 screwed into the threaded shaft 27*a* of the bolt 27, and is structured such that the nut 28 is embedded in the analog block 5 arranged on the first circuit board 11. Therefore, the bottom plate 13, the connection member 17, the second circuit board 12, the housing 10, and the first circuit board 11 can be penetrated by the threaded shaft 27*a* of the bolt 27 with them being overlapped with one another and the threaded shaft 27*a* can be screwed into the nut 28 in the analog block 5. In this state, the bolt 27 can be reliably and firmly fastened.

Accordingly, in this fixing member 18, when the threaded shaft 27*a* of the bolt 27 projecting into the analog block 5 from the first circuit board 11 is screwed into and fastened to the nut 28, the bottom plate 13 can be pressed against the main body attachment section 23 of the main body section 20 of the connection member 17 by the head section 27*b* of the bolt 27, and the main body attachment section 23 can be pressed against the support projection section 26 of the housing 10 arranged in the notch section 12*c* in the second circuit board 12. Therefore, the connection member 17 can be reliably and firmly fixed to the housing 10.

Also, in the fixing member 18, when the threaded shaft 27*a* of the bolt 27 projecting into the analog block 5 from the first circuit board 11 is screwed into and fastened to the nut 28, the first circuit board 11 can be pressed against the upper surface of the housing 10 by the nut 28. Therefore, the upper end 21*a* of the first contact section 21 can be reliably brought into contact with the first electrode 11*a* of the first circuit board 11 from below and the lower end 22*a* of the second contact section 22 can be reliably brought into contact with the second electrode 12*b* of the second circuit board 12 from above. As a result, the connection state can be further stabilized, which further enhances the connection reliability.

In the above-described embodiment, the structure has been described in which the first contact section 21 of the connection member 17 in the connection device 16 is formed by being inclined obliquely upward from the one side portion of the holding section 25 of the main body section 20 and the second contact section 22 is formed by being inclined obliquely downward from the one side portion of the holding section 25 of the main body section 20. However, the present invention is not limited thereto. For example, the present invention may be structured as shown in a first modification in FIG. 8A to FIG. 8D.

More specifically, a connection member 30 in the first modification shown in FIG. 8A to FIG. 8D is structured such that a first contact section 31 is bent upward (downward in FIG. 8C) at a substantially right angle from one side portion of a holding section 25 on a main body section 20 of the connection member 30, its bent upper end (lower end in FIG. 8D) portion is further bent into a mountain shape (a valley shape in FIG. 8D) to forma contact piece 31*a*, and the contact piece 31*a* is brought into resilient contact with the first electrode 11*a* of the first circuit board 11.

Also, the connection member 30 in the first modification is structured such that a second contact section 32 is bent downward (upward in FIG. 8C) at a substantially right angle from the one side portion of the holding section 25 on the main body section 20 of the connection member 30, its bent lower end (upper end in FIG. 8D) portion is further bent into a valley shape (a mountain shape in FIG. 8D) to form a contact piece 32*a*, and the contact piece 32*a* is brought into resilient contact with the second electrode 12*b* of the second circuit board 12. With this structure as well, functions and effects that are the same as those of the connection member 17 in the above-described embodiment can be acquired.

Also, the present invention is not limited to the connection member 17 in the above-described embodiment and the connection member 30 in the first modification. For example, the present invention may be structured as shown in a second modification in FIG. 9A to FIG. 9D. More specifically, a connection member 35 in the second modification is structured such that a first contact section 36 and a second contact section 37 are respectively formed extending in different directions from a leading end of a holding section 25 on a main body section 20 of the connection member 35.

In this case, the first contact section 36 is formed such that it is inclined diagonally upward to the right (diagonally downward to the left in FIG. 9D) from the holding section

25 of the main body section 20, and its inclined upper end (lower end in FIG. 9D) portion 36*a* is brought into resilient contact with the first electrode 11*a* of the first circuit board 11.

Also, in this connection member 30, the second contact section 37 is formed such that it is inclined diagonally downward to the left (diagonally upward to the left in FIG. 9D) from the holding section 25 of the main body section 20, and its inclined lower end (upper end in FIG. 9D) portion 37*a* is brought into resilient contact with the second electrode 12*b* of the second circuit board 12. With this structure as well, functions and effects that are the same as those of the connection member 17 in the above-described embodiment can be acquired.

In the above-described embodiment and the modifications, the cases have been described in which the present invention is applied in a wristwatch. However, the present invention is not necessarily required to be applied in a wristwatch. For example, the present invention is applicable to various types of timepieces such as a travel watch, an alarm clock, a table clock, and a wall clock. Also, the present invention is not necessarily required to be applied in a timepiece, and is widely applicable to electronic devices such as a mobile phone and a personal digital assistant.

While the present invention has been described with reference to the preferred embodiments, it is intended that the invention be not limited by any of the details of the description therein but includes all the embodiments which fall within the scope of the appended claims.

What is claimed is:

1. A connection device comprising:

a plurality of substrates which are arranged overlapping with one another at predetermined intervals, wherein the plurality of substrates comprise electrodes provided on respective opposing surfaces thereof;

a connection member comprising:

a main body section that is fixed to any one of the plurality of substrates; and a plurality of contact sections that are provided on the main body section and arranged among the plurality of substrates so as to respectively come in contact with the electrodes;

a conductive member which is connected to a power source in a state of being in contact with the main body section of the connection member;

a screw member which fixes the plurality of substrates and the main body section of the connection member with the plurality of substrates and the main body section of the connection member being overlapped with each other, wherein the plurality of substrates comprise a first substrate and a second substrate, wherein the connection device comprises a spacer member arranged between the first substrate and the second substrate, wherein the spacer member is provided with an opening section wherein the plurality of contact sections are arranged, wherein the electrodes are respectively provided on opposing surfaces of the first substrate and the second substrate positioned in an area corresponding to the opening section, wherein the main body section of the connection member comprises:

a main body attachment section which is arranged in the spacer member;

an extension section which extends toward an area between the second substrate and the first substrate from the main body attachment section; and a holding section which is provided between the first substrate and the second substrate in a manner to extend substantially parallel to the first substrate and the second substrate from the extension section, and comprises the plurality of contact sections, and wherein the conductive member arranged on a lower surface of the second substrate and the main body attachment section are co-fastened and fixed by the screw member in a state of being overlapped.

2. The connection device according to claim 1, wherein the plurality of contact sections comprises:

a first contact section which is provided on the holding section of the main body section and resiliently comes in contact with a first electrode provided on a lower surface of the first substrate positioned on an upper surface of the spacer member, and a second contact section which is provided on the holding section of the main body section and resiliently comes in contact with a second electrode provided on an upper surface of the second substrate positioned on a lower surface of the spacer member.

3. The connection device according to claim 2, wherein the first contact section is formed extending upward from one side portion of the holding section of the main body section, and the second contact section is formed extending downward from the one side portion of the holding section of the main body section.

4. The connection device according to claim 3, wherein the screw member penetrates, fastens, and fixes a conductive member connected to a power source, the main body section of the connection member, the second substrate, the spacer member, and the first substrate in order.

5. The connection device according to claim 2, wherein the screw member penetrates, fastens, and fixes a conductive member connected to a power source, the main body section of the connection member, the second substrate, the spacer member, and the first substrate in order.

6. The connection device according to claim 3, wherein the screw member penetrates, fastens, and fixes a conductive member connected to a power source, the main body section of the connection member, the second substrate, the spacer member, and the first substrate in order.

7. A timepiece comprising the connection device according to claim 1.

8. The connection device according to claim 1, wherein the extension section is arranged along an inner side surface of a projection section provided in an outer peripheral portion of the spacer member, and wherein the main body attachment section is structured such that, when the main body attachment section is arranged on a lower surface of the projection section, the lower surface of the main body attachment section is substantially flush with the lower surface of the second substrate.

* * * * *